United States Patent [19]

Hunsucker

[11] 4,180,382

[45] Dec. 25, 1979

[54] DURABLE PRESS FINISHING WITH OXAZOLIDINE CATALYSTS

[75] Inventor: Jerry H. Hunsucker, Terre Haute, Ind.

[73] Assignee: International Minerals & Chemical Corp., Terre Haute, Ind.

[21] Appl. No.: 812,079

[22] Filed: Jul. 1, 1977

[51] Int. Cl.[2] ..... D06M 13/34

[52] U.S. Cl. ..... 8/185; 8/182; 8/183; 8/184; 8/186

[58] Field of Search ..... 8/182, 183, 184, 185, 8/186

[56] References Cited

U.S. PATENT DOCUMENTS 3,878,123 5/1975 Reinert et al. ..... 252/426

FOREIGN PATENT DOCUMENTS 1048862 1/1959 Fed. Rep. of Germany ..... 8/183

OTHER PUBLICATIONS

Textile Research Journal, vol. 38, 1968, p. 401.
Textile Research Journal, vol. 47, 1977, p. 181.
Chemical Reviews, vol. 53, 1953, pp. 309–352.
Hall, A. J., A Handbook of Textile Finishing, National Trade Press Ltd., London, 1957, p. 164.

*Primary Examiner*—Donald E. Czaja
*Assistant Examiner*—Maria S. Tungol
*Attorney, Agent, or Firm*—Robert H. Dewey; Howard E. Post

[57] ABSTRACT

An improvement in the process of preparing wrinkle resistant textile fabrics containing cellulosic fiber wherein said fabrics are impregnated with an N-methylol durable press resin and cured. The improvement comprises adding to the durable press resin an oxazolidine or mixture of oxazolidines having the general formula

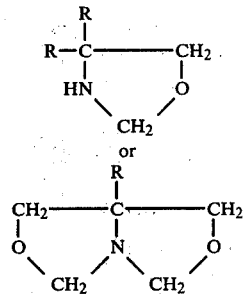

wherein R is selected from the group consisting of H, methyl, ethyl, hydroxymethyl and hydroxyethyl.

18 Claims, No Drawings

DURABLE PRESS FINISHING WITH OXAZOLIDINE CATALYSTS

BACKGROUND OF THE INVENTION

This invention relates to an improvement in the process of preparing wrinkle resistant textile fabrics.

Specifically, this invention relates to an improvement in the process of preparing wrinkle resistant fabrics containing cellulosic fibers by impregnating said fabric with an N-methylol type durable press resin and curing said resin-treated fabric.

This invention further relates to an improvement in the process of preparing wrinkle resistant fabrics containing cellulosic fibers by impregnating said fabric with an N-methylol type durable press resin and curing said resin in the presence of sulfur dioxide.

Wrinkle resistance and durable press properties in textile fabrics are well established and are of great importance and economic value to the textile industry. The majority of textile articles, both wearing apparel and household articles, available in the marketplace exhibit these properties to some beneficial degree. Although many synthetic fibers inherently possess resiliency and wrinkle resistance, fabrics containing cellulose fibers must be chemically treated to acquire these important properties needed for the modern textile market.

The principal chemical treatments which produce wrinkle resistance and durable press properties in cellulose containing textiles are those in which the cellulose molecules are crosslinked, generally by reaction of a di- or polyfunctional agent with the cellulose. Many of the agents employed by the textile processing industry to produce durable press properties in cellulosic fabrics are N-methylol adducts. To enhance the reactions between the cellulose and these adducts many compounds or catalysts may be employed.

The process is known to use sulfur dioxide as a catalyst with formaldehyde to cross-link cotton fabrics and thereby impart and improve the wrinkle recovery angles of the cloth. Wilson and coworkers, *Textile Research Journal,* Volume 38, 1968, page 401, have used gaseous techniques employing sulfur dioxide and formaldehyde in finishing cellulose-containing textiles. The strong protonic acid, hydroxymethanesulfonic acid (HMS), resulting from the reaction of sulfur dioxide, formaldehyde and water in the treatment is "self limiting" in that it dissociates as the fabric dries so that the components volatilize to give a built-in safety mechanism against over reaction or acid degradation. The HMS is formed in situ on the cloth to catalyze the curing of a durable press resin. Moisture content of the textile with sulfur dioxide and formaldehyde curing is critical. If the moisture content is above 14%, much of the reaction occurs under swollen conditions. Under such swollen conditions the fiber cannot collapse to the extent necessary to develop useful dry wrinkle resistance. There is difficulty in adjusting the moisture content to about 14% at a temperature below that at which much crosslinking takes place. Due to the undesirable properties of formaldehyde, there is a growing trend in the fabric finishing industry to reduce the use of formaldehyde.

Reinhardt, Kullman, Cashen and Reid determined that HMS is effective as a catalyst for durable press finishing of cotton and polyester/cotton fabrics. MHS is a strong acid and can be used in relatively small concentrations. Reinhardt et al developed an odor-free process for preparing HMS for use as a catalyst which is the subject of U.S. Pat. No. 3,878,123. HMS can be prepared in situ in the pad bath during which the fabric is impregnated with the durable press resin. The acid is readily formed upon the addition of sulfurous acid to pad baths containing free formaldehyde or it can be prepared separately. Sulfurous acid is readily formed by dissolving sulfur dioxide in water. The HMS dissociates when the fabric becomes dry during finishing to yield components which are readily volatilized from the fabric. An after wash is not necessary to prevent loss of strength or wrinkle resistance subsequent to curing.

Reinhardt and Kullman have further studied sulfonic acids and sulfonate salts as catalysts in durable press finishing. *Textile Research Journal,* Volume 47, 1977, page 181. Included in the study were alkyl, substituted alkyl and aromatic sulfonic acids and ammonium, amine and metal sulfonate salts. The sulfonic acids were shown by Reinhardt and Kullman to be strong catalysts for durable press properties at low concentrations. The sulfonate salts were shown, generally, to be more moderate catalysts than the acids.

SUMMARY OF THE INVENTION

It is an object of this invention to provide an improvement in the process of preparing wrinkle resistant textile fabrics.

Another object of this invention is to provide an improvement in the process of preparing wrinkle resistant fabrics containing cellulosic fibers by impregnating said fabrics with an N-methylol type durable press resin and curing said resin treated fabrics.

Still another object of this invention is to provide an improvement in the process of preparing wrinkle resistant fabrics containing cellulosic fibers by impregnating said fabric with an N-methylol type durable press resin and curing said resin treated fabric in the presence of sulfur dioxide.

Other objects of this invention will be apparent to those skilled in the art from the disclosure herein.

An improvement has been found in the process of preparing wrinkle resistant textile fabrics containing cellulosic fiber wherein said fabrics are impregnated with an N-methylol durable press resin and cured. The improvement comprises adding to the durable press resin an oxazolidine or mixture of oxazolidines having the general formula

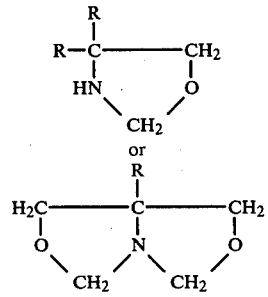

wherein R is selected from the group consisting of H, methyl, ethyl, hydroxymethyl and hydroxyethyl.

DETAILED DISCUSSION

Included in the textiles which can be treated by the improved process of this invention are cellulose fibers, yarns, fabrics and the like. The fabrics can be woven, knitted or non-woven. The cellulose can be natural such as cotton, linen, ramie and the like, or regenerated such as viscose and other types of rayon. In addition to textile materials consisting wholly of cellulose, blends of cellulose fibers and synthetic fibers can be treated. Among these, a particularly amenable type of blend is that containing cotton and polyester fibers.

The process of this invention can be used to impart durable press qualities to textiles using N-methylol type resins as finishing agents to produce the desired durable press qualities. N-Methylol type finishing agents that can be used include formaldehyde adducts of urea, modified ureas such as ethyleneureas, dihydroxyethyleneureas, glyoxalureas, propyleneureas, urons, triazones and the like, triazines and carbamates. N-Alkoxymethyl derivatives of these nitrogenous substances also can be used. These agents can be used in amounts varying from about 3% to about 20% by weight, based upon the weight of the treatment bath. Preferably, from about 9% to 15% of the N-methylol or N-alkoxymethyl finishing agent is used.

To impart durable press properties on cloth, the cloth is impregnated with a durable press resin finishing agent such as those mentioned above. It is then necessary to cure or set the resin to obtain the durable press or wrinkle recovery benefits. Curing of the resin polymerizes the resin to a degree and imparts to the cloth on which it is impregnated a resiliency such that the resin and cloth seek to retain or recover their initial configuration. Generally, a finishing agent is cured by applying heat for a period of time to promote polymerization of the finishing agent. The amount of heat and period of time that it is applied will depend upon the particular finishing agent. It is desirable to only polymerize the finishing agent to a degree. If a finishing agent is polymerized to too great an extent, it will crack or break when creased. That is, the cloth will not recover when bent past a given critical angle. Too little polymerization will not impart the resiliency necessary to obtain durable press properties. Thus, too little or too much polymerization of the finishing agent is undesirable.

In addition to the N-methylol or N-alkoxymethyl finishing agents, catalysts can be employed to assist in the cure of the finishing agents. Catalysts of choice will depend, generally, on the finishing agent but catalysts that are useful include $MgCl_2$ and acid salts of amines. Use of these catalysts can increase the rate of curing of the durable press resin. The catalysts are compatible with the oxazolidines of this invention and do not inhibit nor interfere with the beneficial activity during curing provided by the oxazolidines. The use of resin-setting catalysts is not required by the process of this invention, however, when such catalysts are employed the curing of the durable press resin can be enhanced.

The oxazolidine compounds contemplated for use in the process of this invention are commercially available and the commercially available oxazolidines are suitable for use in the process. The oxazolidines can also be prepared by the condensation reaction, well-known within the art, in which the appropriate amino alcohol is condensed with formaldehyde. The reaction is discussed by Bergmann, *Chemical Reviews* 53, 309–352 (1953). The oxazolidines are employed in the practice of this invention at a concentration of from about 1% to about 30% by weight of the N-methylol finishing agent employed. The oxazolidines can be added directly to the finishing agent bath without adversely affecting the quality of the finishing agent. The oxazolidine and finishing agent are mutually compatible and can, therefore, be impregnated on the textile in one concomitant step. The manner of contacting the textile to be treated with the oxazolidine and finishing agent mixture can be performed in any convenient manner such as by dipping, padding, spraying and the like.

The textile impregnated with the finishing agent and oxazolidine is then heat cured to set the finishing agent. Generally, the textile is exposed to heat for a given period of time to cure the resin. The temperature and time of curing will vary dependent upon the N-methylol durable press resin and amount of oxazolidine employed. Curing temperatures can range from about 20° C. to about 350° C. The time for curing varies inversely with the temperature but generally will be from about 1 minute to about 48 hours. Preferably, curing is accomplished at a high temperature for a short period of time, such as about 150° to 170° C. for about 1 to 3 minutes.

The textile coated with the finishing agent and oxazolidine can also be treated in an atmosphere of $SO_2$ to cure or set the finishing agent. The curing is conducted in an $SO_2$ atmosphere for a period of time that is dependent upon the temperature at which the curing is conducted. Curing temperatures can range from about 20° C. to about 350° C. Curing times can range from about 1 minute to about 48 hours, depending upon the temperature, catalyst, if any, and amount of oxazolidine. Preferably, curing under $SO_2$ is accomplished at a temperature range of about 50° C. to about 120° C. at a time of about 3 minutes up to about 12 hours.

For illustration of the process of this invention, details and specific examples are presented. The instant invention is not to be construed as limited in scope by these illustrations and numerous embodiments within the concept of the invention will be apparent to those skilled in the art.

EXAMPLE 1

A durable press resin solution is prepared by charging 120 g (2 g-moles) of urea and 162 g (3 g-moles) of 37% formaldehyde to a flask. The pH was adjusted to 9.0 with 10% NaOH. The mixture was heated to 80° C. and held for two hours. The mixture was cooled to room temperature and 290 g (2 g-moles) of 40% glyoxal were added. The temperature of the mixture was raised to 70° C. and held for two hours. The mixture was then cooled and filtered. The filtrate was a base resin solution of a glyoxalurea type that would provide durable press properties to cellulose containing textiles.

To 115.4 g of the base resin was added 5.90 g of 4,4-dimethyloxazolidine, 10.10 g of water and 30 g of a 50% aqueous solution of $MgCl_2$. The mixture was heated to 60° C. for one hour then cooled to room temperature. The pH of the resulting durable press solution was 6.40.

Cloth selected for treatment was cotton fabric No. 400, 80×80 (threads per inch) print cloth (carded) desized and bleached with no blueing, optical bleach, or finishing material present. The cloth was cut into strips 15×40 mm in both the warp and file of the cloth. The cloth strips were dipped into the durable press solution prepared in the preceding paragraph. The cloth was padded dry. The cloth was then cured at 325° F. (163° C.) for 120 sec. Following curing, the cloth was tested for wrinkle recovery by the recovery angle method as described in the American Association of Textile Chemists and Colorists (AATCC) Test Method 66-1968.

The warp recovery angles for the two replicates run were 133° and 130° for an average warp recovery angle of 132°. The file recovery angles were 139° and 128° for an average file recovery angle of 134°. The control fabric tested using the base durable press resin without any oxazolidines had an average warp recovery angle of 85° and average file recovery angle of 124°.

The addition of the oxazolidine to the durable press resin is shown hereby to have increased the wrinkle recovery angle of the cotton fabric.

EXAMPLE 2

The experiment of Example 1 was repeated in all essential details with the exception that the oxazolidine added to the base resin was an oxazolidine having the formula

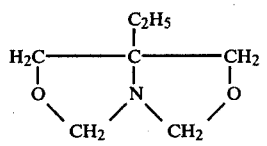

The resultant pH of the durable press solution was 9.03.

The warp recovery angles were 131° and 128° for an average warp recovery angle of 130°. The file recovery angles were 129° and 125° for an average file recovery angle of 127°.

The addition of the oxazolidine to the durable press resin is shown hereby to have increased the wrinkle recovery angle of the cotton fabric.

EXAMPLE 3

The experiment of Example 1 was repeated in all essential details with the exception that 16.0 g of an oxazolidine having the formula

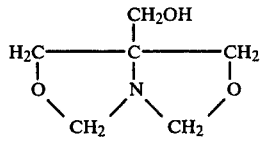

were added to 115.4 g of the base resin to give a durable press resin solution having a pH of 5.37.

The warp recovery angles were 139° and 139° for an average warp recovery angle of 139°. The file recovery angles were 133° and 128° for an average file recovery angle of 131°.

The addition of the oxazolidine to the durable press resin is shown hereby to have increased the wrinkle recovery angle of the cotton fabric.

EXAMPLE 4

The cloth selected for treatment was cotton fabric No. 400, 80×80 print cloth (carded) desized and bleached with no blueing, optical bleach, or finishing material present. The cloth test samples were cut into strips 15×40 mm, cut in both the warp and file of the cloth. The cloth strips were dipped into a solution, prepared as described below, of an N-methylol type of durable press resin, $MgCl_2$ and oxazolidine. A glyoxalurea resin was used as the N-methylol durable press resin. The cloth was then padded dry and placed in an atmosphere of $SO_2$. A vacuum jar was used to contain the $SO_2$ vapors.

The primary durable press resin solution used to impregnate the cloth strips was made by combining 10.6 g of glyoxalurea, 13.4 g of water and 2.4 g of $MgCl_2$. This solution was used as a control against which solutions containing varying amounts of the oxazolidine were tested. Five test solutions containing 4,4-dimethyloxazolidine were prepared by combining 24.0 g of the glyoxalurea resin, 2.4 g of $MgCl_2$ and respectively 1, 2, 3, 4 and 5 g of the oxazolidine.

The test strips of cloth were dipped respectively into the control solution and five solutions of varying concentrations of 4,4-dimethyloxazolidine. The cloth was padded dry and placed into a vacuum jar with 10 g of $SO_2$. The resin was allowed to cure at room temperature (about 22°–23° C.) for 42 hours.

Following curing, the cloth was treated for wrinkle recovery by the recovery angle method as described in the American Association of Textile Chemists and Colorists (AATCC) Test Method 66-1968.

The following results were obtained.

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 70° | 32° | 65° | 93° | 104° | 106° |
| File Recovery Angle | 35°* | 69° | 92° | 112° | 109° | 118° |

*Cracked

This example demonstrates that the use of the oxazolidine in the curing of the cloth enhanced the durable press qualities of the cloth. The results of the tests show that the addition of the oxazolidine to the finishing agent increased the wrinkle recovery angle of the finished cloth.

EXAMPLE 5

The experiment of Example 4 was repeated in all essential details with the exception that the oxazolidine used in the curing of the durable press resin was

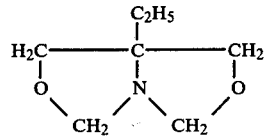

Following curing as in Example 4, the cloth was tested for wrinkle recovery and the following results were obtained.

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 70° | 63° | 72° | 83° | 102° | 98° |
| File Recovery Angle | 35°* | 68° | 95° | 102° | 120° | 125° |

*Cracked

This example demonstrates that the use of the oxazolidine in the curing of the cloth enhanced the durable press qualities of the cloth. The results show the addition of the oxazolidine to the finishing agent increased the wrinkle recovery angle of the finished cloth.

EXAMPLE 6

The experiment of Example 4 was repeated in all essential details with the exception that the oxazolidine used to assist in the curing of the durable press resin was

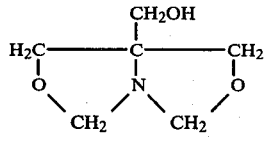

Following curing as in Example 4, the cloth was tested for wrinkle recovery and the following results were obtained.

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 70° | 87° | 80° | 83° | 99° | 110° |
| File Recovery Angle | 35°* | 82° | 85° | 108° | 109° | 128° |

*Cracked

This example demonstrates that the addition of the oxazolidine to the finishing agent enhanced the durable press qualities of the cloth by increasing the wrinkle recovery angle of the finished cloth.

EXAMPLE 7

The experiment of Example 4 was repeated in all essential details with the exception that the curing of the durable press resin was conducted at 50° C. for 2 hours in an $SO_2$ atmosphere.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 65° | 79° | 88° | 119° | 129° | 138° |
| File Recovery Angle | 79° | 52° | 95° | 138° | 139° | 149° |

This example demonstrates that the addition of the oxazolidine to the finishing agent enhanced the durable press qualities of the cloth by increasing the wrinkle recovery angle of the finished cloth.

EXAMPLE 8

The experiment of Example 7 was repeated in all essential details with the exception that the bicyclic oxazolidine of Example 5 was added to the durable press resin.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 65° | 69° | 123° | 122° | 132° | 152° |
| File Recovery Angle | 79° | 87° | 105° | 120° | 158° | 148° |

This example demonstrates that the addition of the oxazolidine to the finishing agent enhanced the durable press qualities of the cloth by increasing the wrinkle recovery angle of the finished cloth.

EXAMPLE 9

The experiment of Example 4 was repeated in all essential details except the curing of the durable press resin was conducted at 60° C. for 2 hours under an $SO_2$ atmosphere.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 71°* | 71°* | 70°* | 79°* | 103° | 98° |
| File Recovery Angle | 61°* | 60° | 87° | 82° | 105° | 125° |

*Cracked

This example demonstrates that the addition of the oxazolidine to the finishing agent enhanced the durable press qualities of the cloth by increasing the wrinkle recovery angle of the finished cloth.

EXAMPLE 10

The experiment of Example 9 was repeated in all essential details with the exception that the bicyclic oxazolidine of Example 5 was added to the durable press resin.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 71°* | 60° | 82° | 88° | 99° | 122° |
| File Recovery Angle | 61°* | 90° | 105° | 65° | 128° | 112° |

*Cracked

This example demonstrates that the addition of the oxazolidine to the finishing agent enhanced the durable press qualities of the cloth by increasing the wrinkle recovery angle of the finished cloth.

EXAMPLE 11

The experiment of Example 9 was repeated in all essential details with the exception that the bicyclic oxazolidine of Example 6 was added to the durable press resin.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | 71°* | 140° | 142° | 145° | 142° | 140° |
| File Recovery Angle | 61°* | 142° | 140° | 140° | 138° | 135° |

*Cracked

This example demonstrates that the addition of the oxazolidine to the finishing agent enhanced the durable press qualities of the cloth by increasing the wrinkle recovery angle of the finished cloth.

EXAMPLE 12

The experiment of Example 4 was repeated in all essential details with the exception that the curing of the durable press resin was conducted at 50° C. for 5 hours under an $SO_2$ atmosphere.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | Broke | 52° | 92° | 121° | 131° | 121° |
| File Recovery Angle | 65° | 119° | 125° | 131° | 119° | 119° |

This example demonstrates that the addition of the oxazolidine to the finishing agent enhanced the durable press qualities of the cloth by increasing the wrinkle recovery angle of the finished cloth.

EXAMPLE 13

The experiment of Example 12 was repeated in all essential details with the exception that the bicyclic oxazolidine of Example 5 was added to the durable press resin.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | Broke | 82° | 105° | 110° | 128° | 112° |
| File Recovery Angle | 65° | 128° | 132° | 129° | 120° | 118° |

This example demonstrates that the addition of the oxazolidine to the finishing agent enhanced the durable press qualities of the cloth by increasing the wrinkle recovery angle of the finished cloth.

EXAMPLE 14

The experiment of Example 12 was repeated in all essential details with the exception that the bicyclic oxazolidine of Example 6 was added to the durable press resin.

The results of the wrinkle recovery test were

| | | | | | | |
|---|---|---|---|---|---|---|
| N-Methylol Resin, g | 24.0 | 24.0 | 24.0 | 24.0 | 24.0 | 24.0 |
| $MgCl_2$, g | 2.4 | 2.4 | 2.4 | 2.4 | 2.4 | 2.4 |
| Oxazolidine, g | 0.0 | 1.0 | 2.0 | 3.0 | 4.0 | 5.0 |
| Warp Recovery Angle | Broke | 90° | 90° | 95° | 102° | 92° |
| File Recovery Angle | 65° | 85° | 90° | 90° | 90° | 90° |

This example demonstrates that the addition of the oxazolidine to the finishing agent enhanced the durable press qualities of the cloth by increasing the wrinkle recovery angle of the finished cloth.

EXAMPLE 15

The experiment of Example 4 is repeated in all essential details with the exception that the curing of the durable press resin treated cloth is conducted at 120° C. for 10 minutes.

The cloth exhibits enhanced durable press qualities for treatment of the cloth with the durable press solution increases the wrinkle recovery angle of the finished cloth.

EXAMPLE 16

The experiment of Example 4 is repeated in all essential details with the exception that curing of the durable press resin treated cloth is conducted at 150° C. for 2 minutes.

The cloth exhibits enhanced durable press qualities for treatment of the cloth with the durable press solution increases the wrinkle recovery angle of the finished cloth.

EXAMPLE 17

The experiment of Example 4 is repeated in all essential details with the exception that no $MgCl_2$ catalyst is added to the durable press solution.

The cloth exhibits enhanced durable press qualities for the treatment of the cloth with the durable press solution increases the wrinkle recovery angle of the finished cloth.

I claim:

1. In the process of preparing wrinkle resistant textile fabrics containing cellulosic fiber wherein said fabrics are impregnated with an N-methylol durable press resin and cured, the improvement comprising adding to the durable press resin an oxazolidine or mixture of oxazolidines having the general formula

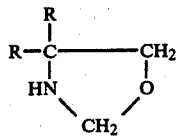

or

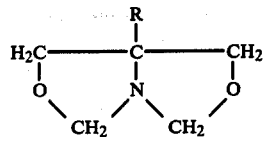

wherein R is selected from the group consisting of H, methyl, ethyl, hydroxymethyl and hydroxyethyl.

2. The process of claim 1 wherein the oxazolidine is

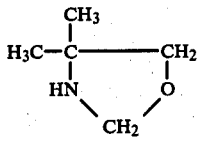

3. The process of claim 1 wherein the oxazolidine is

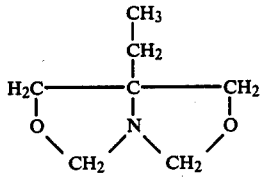

4. The process of claim 1 wherein the oxazolidine is

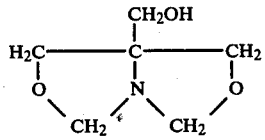

5. The process of claim 1 wherein a glyoxalurea is the N-methylol durable press resin.

6. The process of claim 1 wherein said oxazolidine or mixture of oxazolidines are added to the durable press resin in an amount of from 1 to about 30 percent of said durable press resin.

7. The process of claim 1 wherein $MgCl_2$ is added as a catalyst to the curing process.

8. The process of claim 1 wherein said fabrics impregnated with the durable press resin are cured in an $SO_2$ atmosphere.

9. The process of claim 8 wherein the oxazolidine is

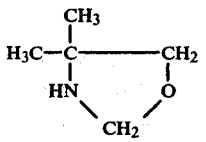

10. The process of claim 8 wherein the oxazolidine is

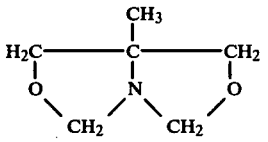

11. The process of claim 8 wherein the oxazolidine is

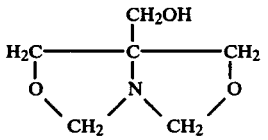

12. The process of claim 8 wherein a glyoxalurea is the N-methylol durable press resin.

13. The process of claim 8 wherein $MgCl_2$ is added as a catalyst to the curing process.

14. The process of claim 8 wherein said oxazolidine or mixture of oxazolidines is added to the durable press resin in an amount of from about 1 to about 30 percent of said durable press resin.

15. The process of claim 8 wherein an oxazolidine or mixture of oxazolidines of the general formula

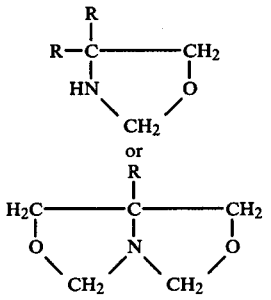

wherein R is selected from the group consisting of H, methyl, ethyl, hydroxymethyl and hydroxyethyl is added to an N-methylol type durable press resin and $MgCl_2$ catalyst, impregnated on the textile and cured at a resin-setting temperature and in a resin-setting amount of time in an $SO_2$ atmosphere.

16. The process of claim 15 wherein said resin-setting temperature is from about 20° C. to about 350° C.

17. The process of claim 15 wherein said resin-setting amount of time is from about 1 minute to about 48 hours.

18. The process of claim 15 wherein said oxazolidine or mixture of oxazolidines is added to the durable press resin in an amount of from about 1 to about 30 percent of said durable press resin.

* * * * *

UNITED STATES PATENT AND TRADEMARK OFFICE

CERTIFICATE OF CORRECTION

PATENT NO. : 4,180,382

DATED : December 25, 1979

INVENTOR(S) : Jerry H. Hunsucker

It is certified that error appears in the above-identified patent and that said Letters Patent are hereby corrected as shown below:

Column 1, line 67, "MHS" should read -- HMS --

Column 6, line 19, "treated" should read -- tested --

Signed and Sealed this

*Second* Day of *December 1980*

[SEAL]

*Attest:*

SIDNEY A. DIAMOND

*Attesting Officer*

*Commissioner of Patents and Trademarks*